US010069208B2

(12) United States Patent
Ammann et al.

(10) Patent No.: US 10,069,208 B2
(45) Date of Patent: Sep. 4, 2018

(54) DUAL-FREQUENCY PATCH ANTENNA

(71) Applicant: TAOGLAS GROUP HOLDINGS, Enniscorthy, County Wexford (IE)

(72) Inventors: Max J. Ammann, Mount Merrion (IE); Xiulong Bao, Dundrum (IE); Liang Wen Ming, New Taipei (TW)

(73) Assignee: TAOGLAS GROUP HOLDINGS LIMITED, Enniscorthy (IE)

( * ) Notice: Subject to any disclaimer, the term of this patent is extended or adjusted under 35 U.S.C. 154(b) by 88 days.

(21) Appl. No.: 15/372,895

(22) Filed: Dec. 8, 2016

(65) Prior Publication Data

US 2017/0170568 A1 Jun. 15, 2017

Related U.S. Application Data

(60) Provisional application No. 62/265,784, filed on Dec. 10, 2015, provisional application No. 62/341,346, filed on May 25, 2016.

(51) Int. Cl.

| | |
|---|---|
| ***H01Q 1/36*** | (2006.01) |
| ***H01Q 9/04*** | (2006.01) |
| ***H01Q 5/49*** | (2015.01) |
| ***H01Q 1/48*** | (2006.01) |
| ***H01Q 13/18*** | (2006.01) |

(52) U.S. Cl.

CPC ..... *H01Q 9/0492* (2013.01); *H01Q 1/36* (2013.01); *H01Q 1/48* (2013.01); *H01Q 5/49* (2015.01); *H01Q 9/0407* (2013.01); *H01Q 13/18* (2013.01)

(58) Field of Classification Search

CPC ..... H01Q 9/0497; H01Q 5/49; H01Q 1/36; H01Q 1/48; H01Q 9/0407; H01Q 13/18

USPC ..... 343/700 MS

See application file for complete search history.

(56) References Cited

U.S. PATENT DOCUMENTS

| | | | |
|---|---|---|---|
| 4,218,682 | A | 8/1980 | Robert et al. |
| 5,815,119 | A | 9/1998 | Helms et al. |
| 6,091,364 | A | 7/2000 | Murakami et al. |
| 6,266,016 | B1 | 7/2001 | Bergstedt et al. |
| 6,281,845 | B1 | 8/2001 | Ittipiboon et al. |
| 6,791,496 | B1 | 9/2004 | Killen et al. |
| 7,471,248 | B2 | 12/2008 | Popugaev et al. |

(Continued)

FOREIGN PATENT DOCUMENTS

| | | |
|---|---|---|
| CN | 203415687 U | 1/2014 |
| CN | 104201463 A | 12/2014 |

*Primary Examiner* — Andrea Lindgren Baltzell

(74) *Attorney, Agent, or Firm* — Shartsis Friese LLP; Cecily Anne O'Regan; Kevin J. Everett, Jr.

(57) ABSTRACT

A 5 dBi embedded dual-band WiFi circular polarized 50 mm patch antenna with an SMA(f) connector is described. The antenna features a high efficiency dual-band WiFi 2.4 GHz/5~6 GHz right hand circular polarization (RHCP). The antennas improve upon the previously developed antennas by simplifying the construction and simplifying the feed, while retaining circular polarization across two widely-separated bands. In order to integrate prior antennas into a system with simple coaxial connections, additional components and devices were required. The antennas simplifies the integration whilst retaining the circular polarization and dual frequency operation. The ratio between the two frequency bands can be adjusted by changing the middle patch and the V-shaped slot size of the top layer. The V-shaped slots improve the axial ratio bandwidth and assist with setting the frequency ration between the two bands.

24 Claims, 20 Drawing Sheets

(56) References Cited

U.S. PATENT DOCUMENTS

| | | | |
|---|---|---|---|
| 8,077,103 | B1 | 12/2011 | Acosta et al. |
| 8,350,771 | B1 | 1/2013 | Zaghloul et al. |
| 2009/0153404 | A1 | 6/2009 | Ryou et al. |
| 2011/0163921 | A1 | 7/2011 | Chirila |
| 2012/0242553 | A1 | 9/2012 | Leung et al. |
| 2012/0280877 | A1 | 11/2012 | Chirila |

| ELECTRICAL | | |
|---|---|---|
| FREQUENCY RANGE (MHz) | 2400-2500 | 5150-5850 |
| RETURN LOSS (dB) | < -7 | < -6 |
| EFFICIENCY (%) | 74.19 | 66.97 |
| PEAK GAIN (dBi) | 5.5 | 7.3 |
| POLARIZATION | RHCP | |
| AXIAL RATIO | MIN. 1.75 | MIN. 1 |
| IMPEDANCE (OHM) | 50 Ω | |
| INPUT POWER | 10W | |
| MECHANICAL | | |
| DIMENSION (mm) | 50 x 50 x 7.07 (WITHOUT CONNECTOR)<br>50 x 50 x 16.57 (WITH CONNECTOR) | |
| ANTENNA PATCH MATERIAL | PTFE COMPOSITES | |
| CONNECTOR | SMA(F) ST | |
| WEIGHT (g) | 32.5 | |
| ENVIRONMENTAL | | |
| OPERATION TEMPERATURE | -40°C ~ + 85°C | |
| STORAGE TEMPERATURE | -40°C ~ + 85°C | |

FIG. 1A

BOTTOM VIEW

SIDE VIEW

TOP VIEW

3D RADIATION PATTERN AT 2450 MHz

DUAL-FREQUENCY PATCH ANTENNA

CROSS-REFERENCE

This application claims the benefit of U.S. Provisional Application No. 62/265,784, filed Dec. 10, 2015, entitled DUAL-FREQUENCY PATCH ANTENNA, and U.S. Provisional Application No. 62/341,346, filed May 25, 2016, entitled DUAL-FREQUENCY PATCH ANTENNA which applications are incorporated herein by reference.

BACKGROUND

Field

The present disclosure relates in general to an antenna and, in particular, to a patch antenna.

Background

Circularly-polarized patch antennas are commonplace, with well-understood properties. These antennas are usually single-resonance, limiting the circular polarization bandwidth. Dual-frequency circularly-polarized patch antennas have in the past required dual or multiple pin feeds, complicating the design by requiring additional system components (see U.S. Pat. No. 5,815,119 A). Other designs involve shorting elements (U.S. Pat. No. 4,218,682 A), or, the dual resonances are near together in frequency. These elements either complicate the feed subsystem design or complicate the construction. Additionally, modifying the design of a dual-band circularly polarized antenna can be difficult, or the frequencies of the bands are limited to those that are harmonically related.

What is needed is an integrated circularly-polarized antenna with dual frequency operation which is easily integratable into a system using a coaxial connection without the limitations previously observed.

SUMMARY

Disclosed is a 5 dBi embedded dual-band WiFi circular polarized 50 mm patch antenna with an SMA(f) connector. The antenna features a high efficiency dual-band WiFi 2.4 GHz/5~6 GHz right hand circular polarization (RHCP). The disclosed antennas improve upon the previously developed antennas by simplifying the construction and simplifying the feed, while retaining circular polarization across two widely-separated bands. In order to integrate prior antennas into a system with simple coaxial connections, additional components and devices were required. This disclosed antennas simplify the integration whilst retaining the circular polarization and dual frequency operation. The ratio between the two frequency bands can be adjusted by changing the middle patch and the V-shaped slot size of the top layer. The V-shaped slots improve the axial ratio bandwidth and assist with setting the frequency ratio between the two bands.

The antenna consists of an advanced composite dielectric structure which improves performance at great distances and for a broader band frequency range. The antenna can be used for unmanned systems, such as unmanned aerial/ground vehicles (UAVs/UGVs), robotics and ground controller/stations. The antenna uses a glass microfiber reinforced polytetrafluoroethylene (PTFE) substrate to minimize signal transmission loss to achieve high efficiency and performs with high efficiencies at WiFi bands from 2400 to ~2500 MHz and 5150 to ~5850 MHz of 74% and 67%, and with peak gains of 5.5 dBi and 7.3 dBi, respectively. As will be appreciated by those skilled in the art, materials other than PTFE can be used without departing from the scope of the disclosure. Other suitable materials include phenylene ether co-polymer (PPE).

An aspect of the disclosure is directed to a planar dual patch antenna. Planar dual patch antennas according to the disclosure comprise: a first planar substrate having a first patch antenna and a v-shaped slot therein; a second planar substrate formed from a composite material with dielectric properties and a square aperture centrally positioned therein; a third planar substrate having a ground layer adhered to one surface and a second patch antenna on an opposing surface; a single-pin feed; and a coupling between the first patch antenna on the first planar substrate and the second patch antenna on the third planar substrate. In some configurations, the first planar substrate is rectangular. Additionally, the first planar substrate can have two truncated corners. Where there are truncated corners, a first truncated corner can have a first length and a second truncated corner can have a second length and the first length does not need to be equal to the second length. The v-shaped slot can have a first slot arm and a second slot arm, and further wherein a length of the first slot arm and a width of a second slot arm is proportional to a length of the second slot arm and a width of the second slot arm. Additionally, the first slot arm can have a dimension that is ⅛ a dimension of the second slot arm. The planar dual patch antenna can also be square or rectangular. The second substrate can have a connector aperture.

Another aspect of the disclosure is directed to a planar dual patch antenna. Planar dual patch antennas according to the disclosure comprise: a first planar substrate means having a first patch antenna means and a v-shaped slot therein; a second planar substrate means formed from a composite material with dielectric properties and a square aperture centrally positioned therein; a third planar substrate means having a ground layer means adhered to one surface and a second patch antenna on an opposing surface; a single-pin feed; and a coupling means between the first patch antenna means on the first planar substrate means and the second patch antenna on the third planar substrate means. In some configurations, the first planar substrate means is rectangular. Additionally, the first planar substrate means can have two truncated corners. Where there are truncated corners, a first truncated corner can have a first length and a second truncated corner can have a second length and the first length does not need to be equal to the second length. The v-shaped slot can have a first slot arm and a second slot arm, and further wherein a length of the first slot arm and a width of a second slot arm is proportional to a length of the second slot arm and a width of the second slot arm. Additionally, the first slot arm can have a dimension that is ⅛ a dimension of the second slot arm. The planar dual patch antenna can also be square or rectangular. The second substrate can have a connector aperture.

Yet another aspect of the disclosure is directed to an antenna kit. Suitable antenna kits comprise one or more dual patch antennas comprising a first planar substrate having a first patch antenna and a v-shaped slot therein, a second planar substrate formed from a composite material with dielectric properties and a square aperture centrally positioned therein, a third planar substrate having a ground layer adhered to one surface and a second patch antenna on an opposing surface, a single-pin feed, and a coupling between the first patch antenna on the first planar substrate and the second patch antenna on the third planar substrate.

INCORPORATION BY REFERENCE

All publications, patents, and patent applications mentioned in this specification are herein incorporated by reference to the same extent as if each individual publication, patent, or patent application was specifically and individually indicated to be incorporated by reference. References include, for example: U.S. Pat. No. 4,218,682 A issued Aug. 19, 1980 for Multiple band circularly polarized microstrip antenna; U.S. Pat. No. 5,815,119 A issued Sep. 29, 1998 for Integrated stacked patch antenna polarizer circularly polarized integrated stacked dual-band patch antenna; U.S. Pat. No. 6,091,364 A published Jul. 18, 2000 for Antenna capable of tilting beams in a desired direction by a single feeder circuit, connection device therefor, coupler, and substrate laminating method; U.S. Pat. No. 6,266,016 B1 published Jul. 24, 2001 for Microstrip arrangement; U.S. Pat. No. 6,281,845 B1 published Aug. 28, 2001 for Dielectric loaded microstrip patch antenna; U.S. Pat. No. 6,791,496 B1 published Sep. 14, 2004 for High efficiency slot fed microstrip antenna having an improved stub; U.S. Pat. No. 7,471,248 B2 published Dec. 30, 2008 for Planar multiband antenna; U.S. Pat. No. 8,077,103 B1 published Dec. 13, 2011 for Cup waveguide antenna with integrated polarizer and OMT; U.S. Pat. No. 8,350,771 B1 published, Jan. 8, 2001 for Dual-band dual-orthogonal-polarization antenna element; US 2009/0153404 A1 published Jun. 18, 2009 for Single layer dual band antenna with circular polarization and single fee point; US 2011/0163921 A1 published Jul. 7, 2011 for UHF RFID internal antenna for handheld terminals; US 2012/0242553 A1 published Sep. 27, 2012 for Elliptically or circularly polarized dielectric block antenna; US 2012/0280877 A1 published Nov. 8, 2012 for Antenna having an embedded radio device; CN203415687U published Jan. 29, 2014 for Substrate integration circular polarization double-frequency band antenna; and CN104201463A published Dec. 10, 2014 for Dual-band circular polarization dielectric antenna.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIG. 1A is a table of exemplar specification ranges for electrical, mechanical and environmental features for an antenna according to the disclosure.

DETAILED DESCRIPTION

Antenna configurations are disclosed. An antenna with subminiature version A female connector (SMA(F)) is provided, attached to the SMA(F) connector is a circular polarized dual-band Wi-Fi antenna which can be formed from a composite dielectric structure. Composite dielectric structures can provide improved performance at greater distances and a broader band frequency range in small package. In some configurations, military grade substrates and components can be used. Additionally, the antenna is suitable for use with unmanned systems, such as unmanned aerial/ground vehicles (UAVs/UGVs), robotics, and ground controllers/stations, applicable in different sectors from civilian, to law enforcement, to defense. As shown in FIG. 1A, the antennas of the disclosure are configurable to have specification ranges for electrical, mechanical and environmental features for an antenna according to the disclosure. Details include exemplar electrical, mechanical and environmental parameters including frequency range, return loss (dB), efficiency (%), peak gain (dBi), polarization, axial ratio, impedance (Ohm), input power, dimensions (with and without connector), antenna patch material, connector type, weight (g), operation temperature, and storage temperature.

Figure 1C:
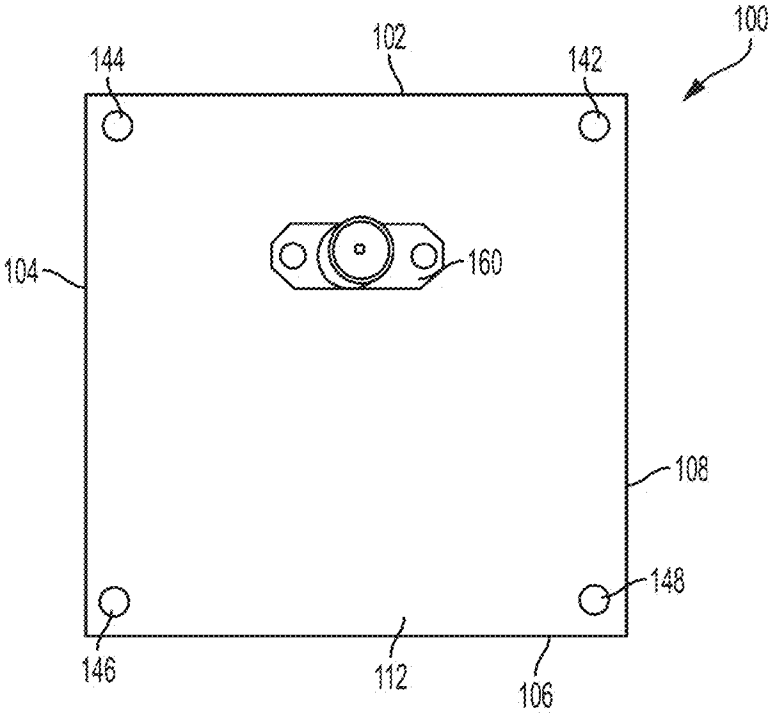
FIGS. 1B-C illustrate a front view and a back view of a suitable antenna.
Figure 1B:
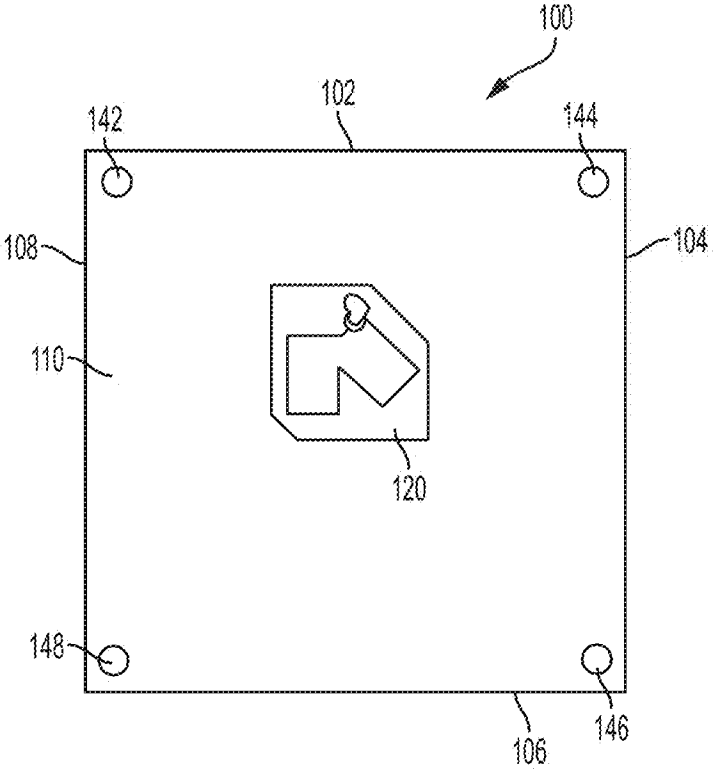

FIGS. 1B-C illustrate a front view and a back view of a suitable antenna. FIG. 1B is a front view of an antenna 100 having an antenna top surface 110. The antenna 100 is planar and, as illustrated, has a first side 102, a second side 104, a third side 106 and a fourth side 108, numbered clockwise when viewed from above. The sides can be situated at 90 degree angles so that the resulting surface forms a rectangle (or square) as illustrated. A plurality of anchor apertures are provided, illustrated a first anchor aperture 142, a second anchor aperture 144, a third anchor aperture 146, and a fourth anchor aperture 148. The plurality of anchor apertures are sized and shaped to receive a securement device therethrough. As shown, the plurality of apertures have a circular cross-section. As illustrated, the plurality of anchor apertures are positioned at the corners of the rectangular (or square) antenna form factor. The plurality of anchor apertures allow attachment of the antenna to a mounting surface via, for instance, suitable threaded fasteners. The plurality of anchor apertures are positionable to facilitate securement of the antenna to a structure. The upper patch 120 of the antenna can be situated centrally on the top surface, as illustrated, but may be positioned in other locations without departing from the scope of the disclosure.

The antenna bottom surface 112 shown in FIG. 1C has a first side 102, a second side 104, a third side 106 and a fourth side 108, as illustrated, and a plurality of anchor apertures (e.g., first anchor aperture 142, second anchor aperture 144, third anchor aperture 146, and fourth anchor aperture 148). A connector 160 is provided on one surface of the antenna 100, shown extending from the bottom side of the antenna, which is typically a type subminiature version A female connector (SMA(F) connector with a screw type coupling mechanism). The connector 160 can be centrally located (but not necessarily centered) on the bottom surface as illustrated. The connector 160 provides a connection to external electronics and a probe feed to the upper patch 120 shown in FIG. 1B.

Figure 2:
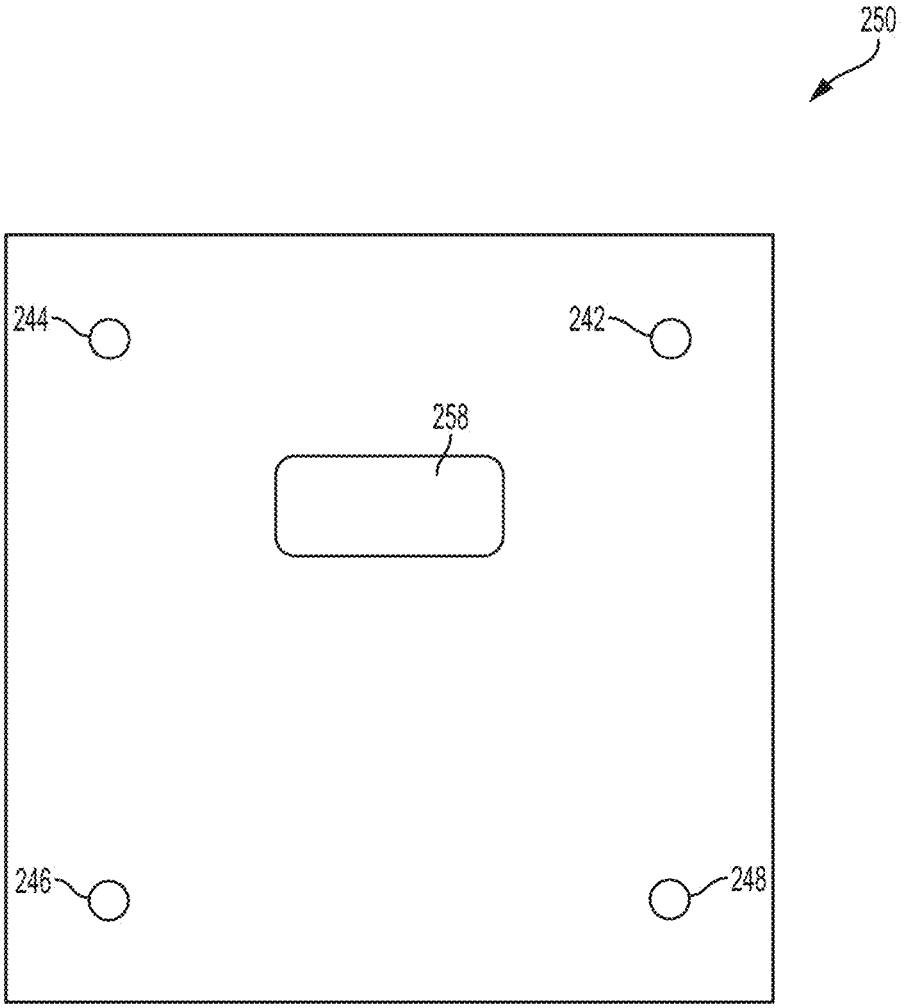
FIG. 2 illustrates a view of an antenna.
Figure 4:
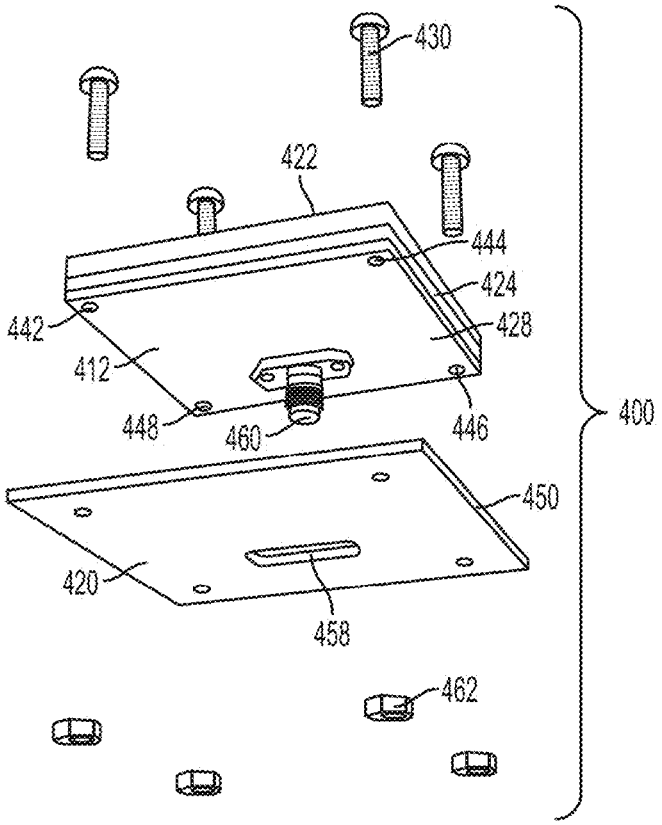
FIGS. 4-5 illustrate a suitable installation method.
Figure 5:
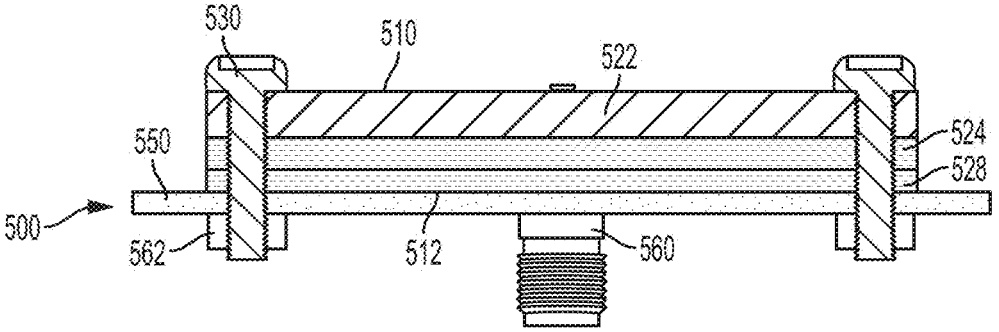

FIG. 2 is a mounting plate 250 shown in more detail in FIGS. 4-5. The mounting plate 250 has a top side and a bottom side and a plurality of apertures (e.g., first anchor aperture 242, second anchor aperture 244, third anchor aperture 246, fourth anchor aperture 248, and connector aperture 258) to receive the anchors and connector. The distance between the center of the first aperture 242 and the second aperture 244 (center to center) is about 44.0 mm. The width of the connector aperture 258 is about 18.0 mm. The height of the connector aperture 250 is about 8.0 mm and it can be positioned such that the center of the connector aperture 258 is positioned 9.0 mm from a cross-section of the mounting plate 250 taken midway between the second aperture 244 and the third aperture 246.

Figure 3A:
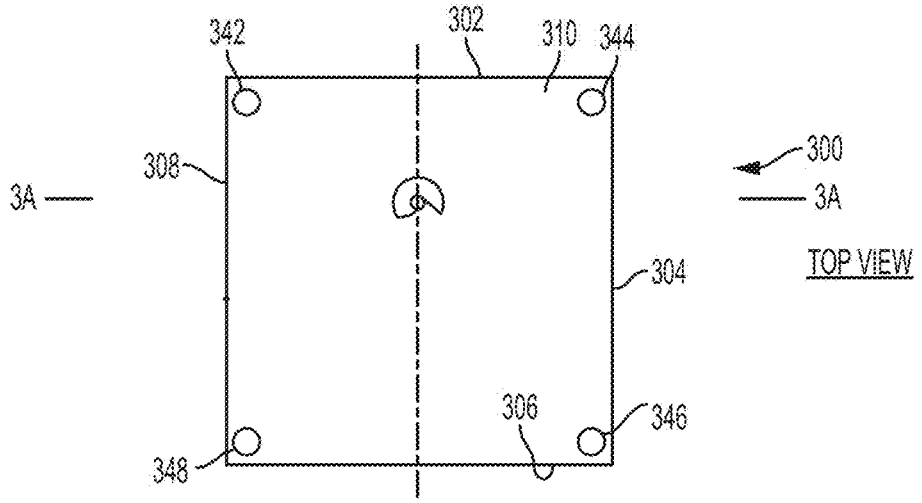
FIGS. 3A-I illustrate a top view, side view, bottom view, and enlarged views for antennas and layers according to the disclosure.

FIGS. 3A-F illustrates additional detail for an embodiment of the antenna 300. FIG. 3A is a top view of antenna 300 from the antenna upper surface 310. The antenna has a first side 302, a second side 304, a third side 306 and a fourth side 308, numbered clockwise when viewed from above. As illustrated, the sides are situated at 90 degree angles so that the resulting surface forms a rectangle (or square) form factor. Other shapes can be used without departing from the scope of the disclosure. Additionally, there are a plurality of securement or anchor apertures, illustrated as four apertures having a circular cross-section (first anchor aperture 342, second anchor aperture 344, third anchor aperture 346, and fourth anchor aperture 348). As illustrated the plurality of securement or anchor apertures are situated at the corners of the rectangle (square) of the antenna 300. These securement apertures facilitate attachment or securement of the antenna to a mounting surface via, for instance, threaded fasteners such as screws or nuts-and-bolts, or other suitable fasteners such as rivets. The width of the antenna 300 is about 50 mm+/−0.5, and the height is about 50 mm+/−0.5 mm. The distance between the first aperture 342 and the second aperture 344 or the second aperture 344 and the third aperture 346 is about 44+/−0.35 mm (center-to-center). The distance between the feed probe location 358 and the first side 302 is about 16+/−0.4 mm. The height of the antenna 300 (shown in FIG. 3B) is about 16.57 mm, the height of the connector 360 is about 9.5+/−0.4 mm, and the thickness of the layers is about 9.07+/−0.4 mm.

Figure 3B:
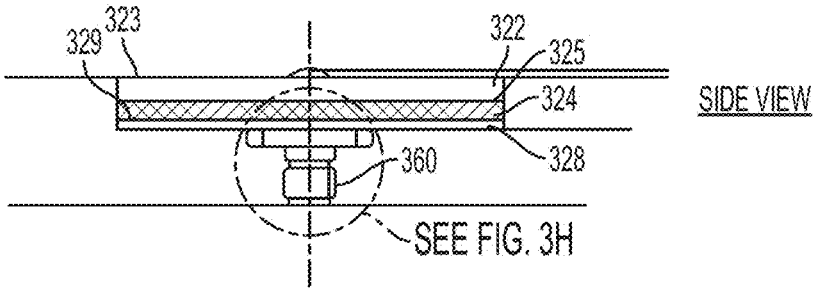

FIG. 3B is a side cross-sectional view of an antenna 300 of FIG. 3A along a plane formed by the lines 3A-3A, illustrating the layered construction of the planar antenna. The antenna top layer 322 can have a typical printed circuit board (PCB) construction and may be of polytetrafluoroethylene (PTFE) composite formulation. Upon its antenna top layer upper surface 323 is an upper patch (not shown). Probe connection, or SMA center pin, provides linkage from the SMA(F) connector 360 to an upper patch (not shown). An antenna middle layer 324 PCB can be provided which is a structure of uniform thickness; it may be comprised of a composite material with suitable dielectric properties. The bottom surface of the antenna top layer PCB can be permanently attached to the antenna middle layer upper surface 325 of the antenna middle layer 324 of the middle layer PCB, typically via a thin sheet of double-sided adhesive (not shown). The antenna bottom layer 328 of the antenna 300 can also be formed from a typical PCB construction and may be of PTFE composite formulation. On the antenna bottom layer upper surface 329 is the lower patch (not shown). On the bottom surface of the antenna bottom layer 328 is an SMA(F) connector which provides linkage to external devices. The antenna bottom layer upper surface 329 of PCB may be permanently attached to the antenna middle layer bottom surface, typically via a thin sheet of double-sided adhesive.

Figure 3C:
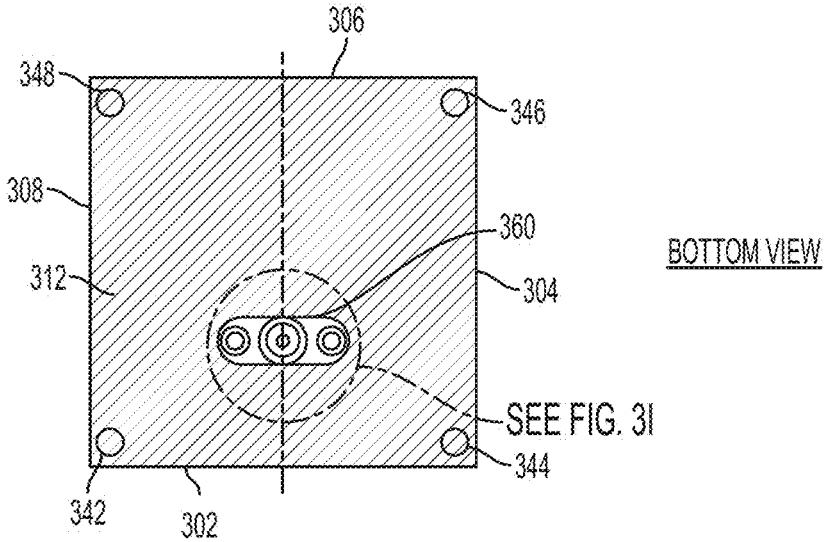

FIG. 3C is a bottom view of antenna 300. The antenna 300 is planar and has an antenna bottom surface 312. The antenna 300 has a first side 302, a second side 304, a third side 306 and a fourth side 308. The sides are shown situated at 90 degree angles so that the resulting surface forms a rectangle (or square). A plurality of securement apertures (illustrated as first anchor aperture 342, second anchor aperture 344, third anchor aperture 346, and fourth anchor aperture 348) can be provided which are shown situated at the corners of the rectangle (square). These securement apertures allow attachment of the antenna 300 to a mounting surface via, for instance, threaded fasteners such as screws or nuts-and-bolts, or other suitable fasteners such as rivets as illustrated in FIG. 4. An SMA(F) connector 360 is attached to the antenna bottom surface 312, which can be located such that its midpoint is midway between opposing sides (for example second side 304 and fourth side 308) and its orthogonal midpoint is 32% of the way between the first side 302 and the third side 306, situated nearer to side 302.

Figure 3D:
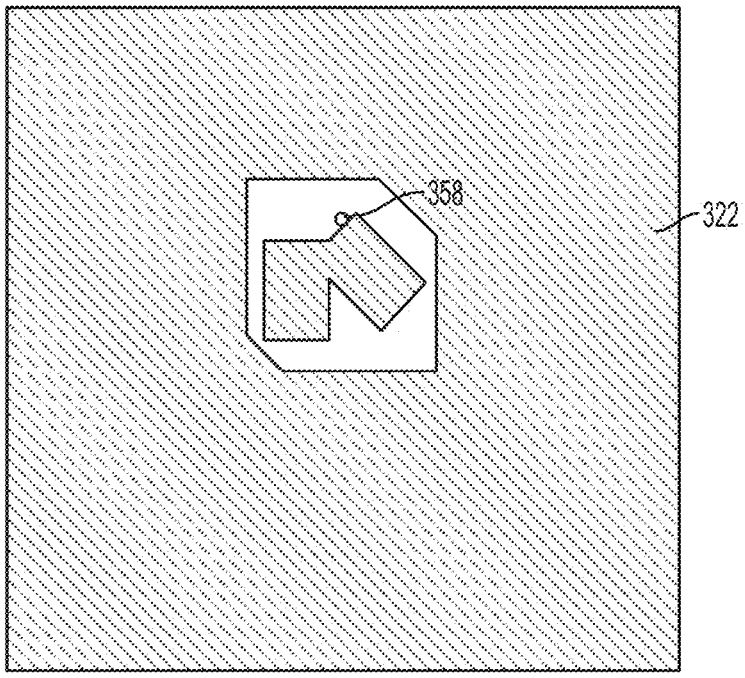
Figure 3E:
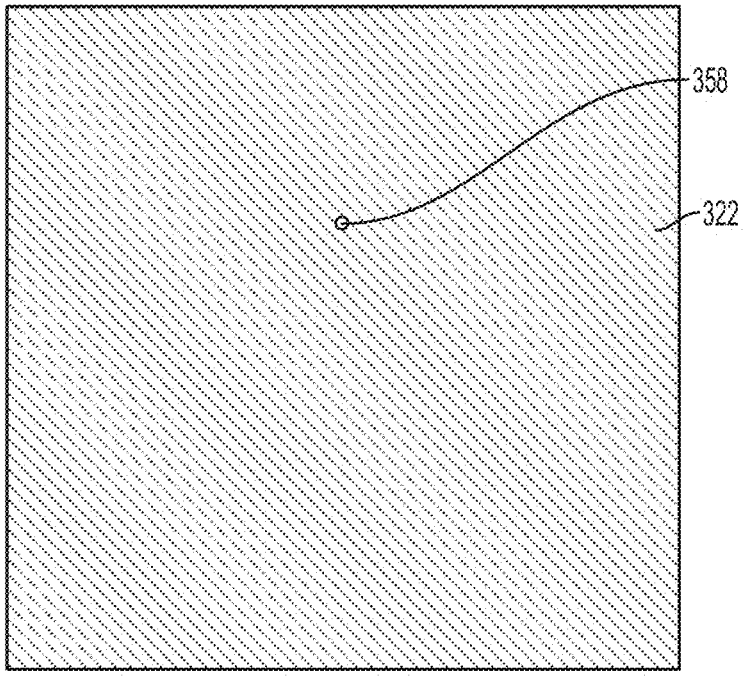

FIG. 3D illustrates the top substrate of the antenna top layer 322 of the antenna showing the feed probe location 358. FIG. 3E is the bottom layer of the top substrate 322 showing the feed probe location 358. The top and bottom layer of the top substrate 322 are adhered together to form a single layer.

Figure 3F:
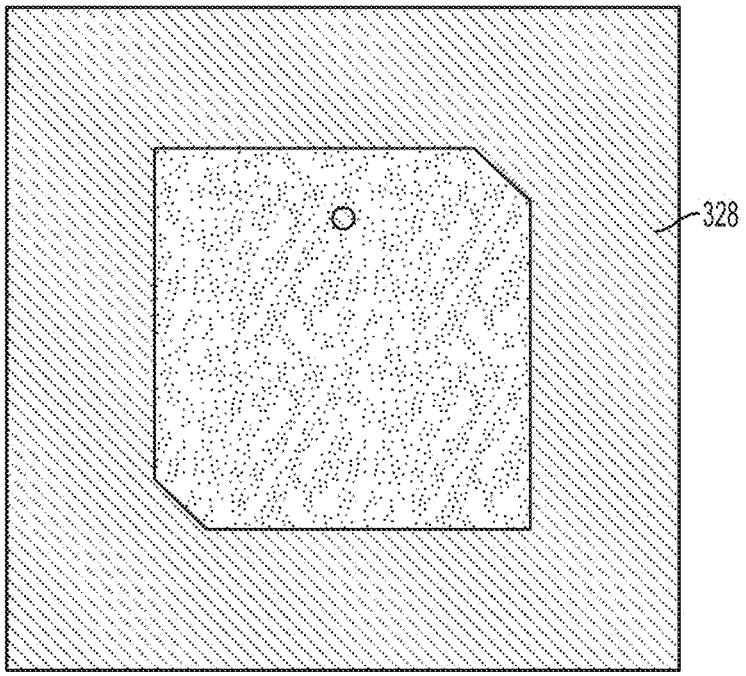
Figure 3G:
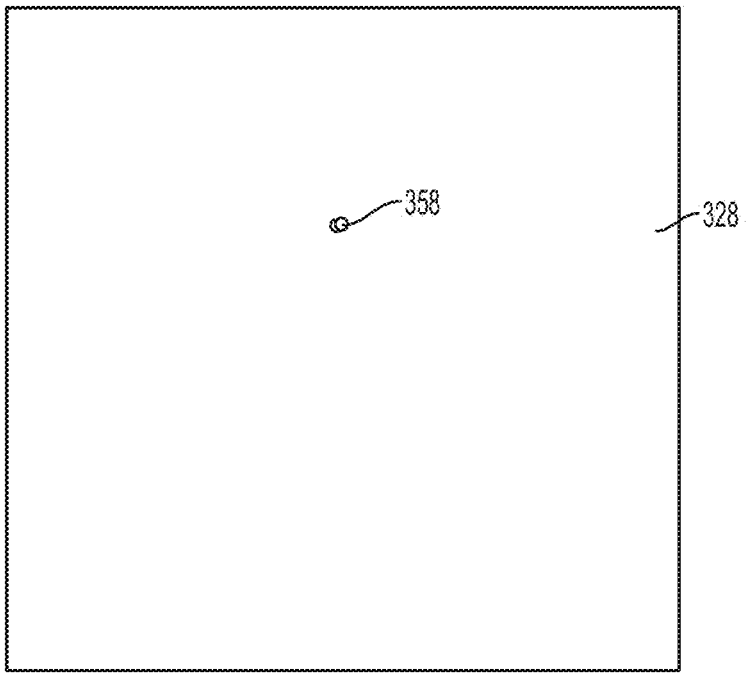

FIG. 3F illustrates the top layer of the bottom substrate 328 with an aperture in the copper for the feed probe location 358 to the top patch. FIG. 3G is the bottom layer of the bottom substrate 328. The top and bottom layer of the bottom substrate 328 are adhered together to form a single layer.

Figure 3H:
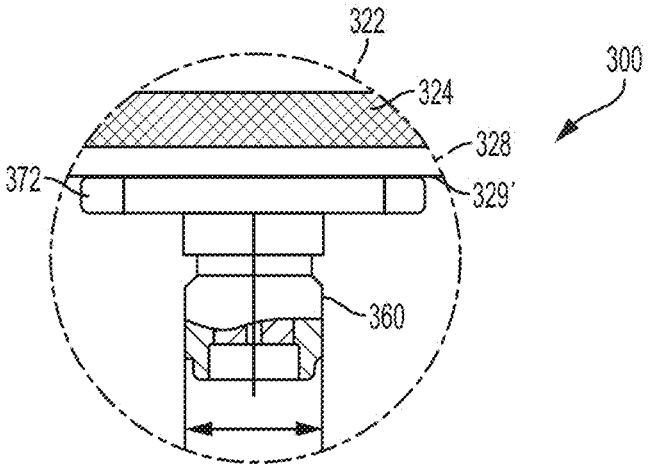

FIG. 3H is an enlarged side view of a portion of the antenna 300, showing the antenna top layer 322, the antenna middle layer 324 and the antenna bottom layer 328. Attached to the antenna bottom layer bottom surface 329' is a typical commercially-available SMA(F) connector 360 and connector base 372

Figure 3I:
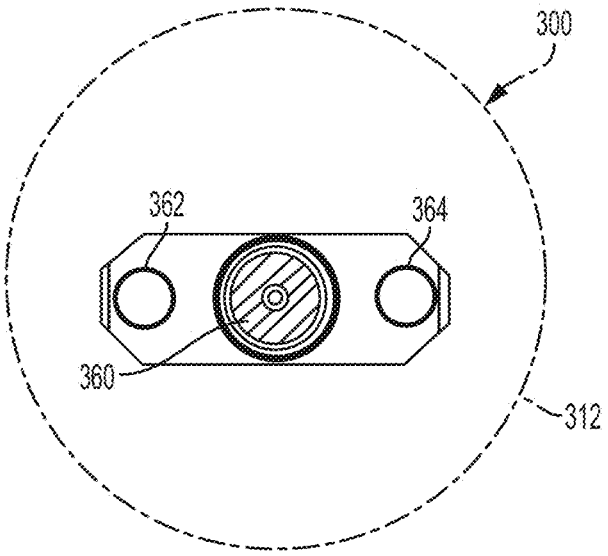

FIG. 3I is an enlarged bottom view of a portion of the antenna 300, looking directly at the antenna bottom surface 312. Attached to the antenna bottom surface 312 of the antenna 300 is a typical commercially-available SMA(F) connector 360. The width of the connector 360 is 16+/−0.5 mm with a distance between the first connector aperture 362 and the second connector aperture 364 (center-to-center) if about 12.2+/−0.5 mm. The height of the connector is about 6+/−0.5 mm.

FIG. 4 shows (in exploded isometric view) a typical mounting configuration for antenna 400 to mounting plate 450, which may be part of a larger structure. The antenna 400 has a planar and rectangular (square) form factor, as illustrated, when viewed from above. The antenna 400 consists of three PCB layers, an antenna top layer 422 of PCB, an antenna middle layer 424 PCB, and an antenna bottom layer 428 as described above with respect to FIG. 3. At the corners of the antenna 400, are a plurality of securement apertures illustrated as four securement apertures (e.g., first anchor aperture 442, second anchor aperture 444, third anchor aperture 446, and fourth anchor aperture 448) of circular cross-section. Attached to the antenna bottom surface 412 of antenna 400 is a connector 460 of type SMA(F). There exists in mounting plate 450 an connector aperture 458 corresponding to the SMA(F) connector such that the connector 460 itself can pass through the mounting plate 450, allowing the bottom surface of antenna 400 to sit flush on the mounting plate 450. Attachment of the antenna 400 to the mounting plate 450 may be accomplished via the use of a plurality of threaded fasteners 430 passed through securement apertures (e.g., first anchor aperture 442, second anchor aperture 444, third anchor aperture 446, and fourth anchor aperture 448) in the antenna 400 and corresponding apertures in the mounting plate 450 and secured using, for example, a plurality of hex nuts 462.

FIG. 5 is a side view section-cut of antenna 500 attached to mounting plate 550. The antenna 500, comprises a top PCB layer 522, a middle PCB layer 524, and a bottom PCB layer 528, which rests atop mounting plate 550. Protruding from the antenna top surface 510 of top PCB layer 522 is a probe connection that links the probe to the top patch (not visible). Protruding from the antenna bottom surface 512 is a connector 560 of type SMA(F). A plurality of threaded fasteners 530 attach antenna 500 from antenna top surface 510 to mounting plate 520 and are secured by, for example, a plurality of hex nuts 562 on bottom surface of mounting plate 550. The distance between the top surface of the mounting plate 550 and the top surface of the top PCB layer 522 (on which the head of the non-conductive threaded fastener 530 sits) is about 7.07 mm. The thickness of the hex nut 562 is about 2.5 mm.

Figure 6C:
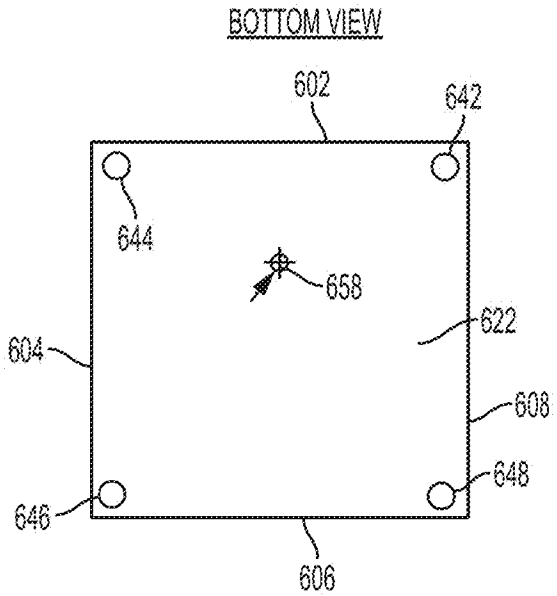
FIGS. 6A-E illustrates antenna components according to the disclosure.
Figure 6B:
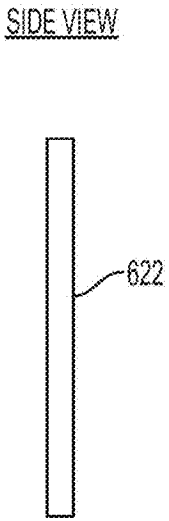
Figure 6A:
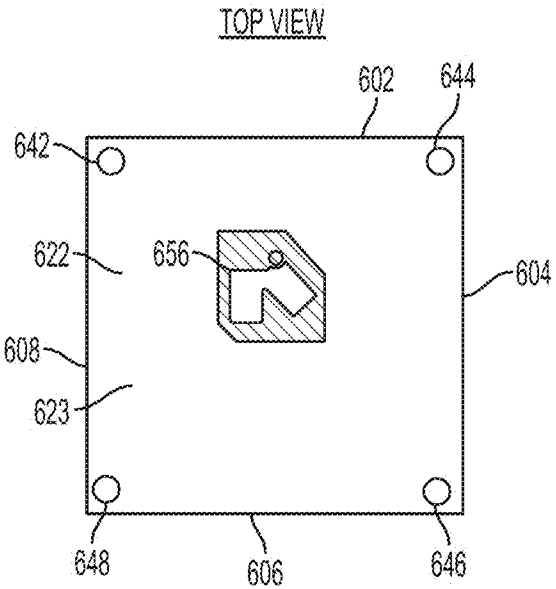

FIGS. 6A-E illustrate the top layer PCB with an upper patch antenna 656. FIG. 6A is a top view of the antenna top layer 622 PCB. The antenna top layer 622 is of typical PCB construction and may be of PTFE composite formulation. The antenna top layer 622 can be planar, as illustrated, and of uniform thickness. The antenna top layer 622, as discussed above, can be formed from a top substrate with a feed probe connection and a bottom layer. The antenna top layer 622 has a top side and a bottom side along with a first side 602, a second side 604, a third side 606 and a fourth side 608, numbered clockwise when viewed from the top side. The sides (first side 602, second side 604, third side 606 and fourth side 608) are situated at 90 degree angles so that the resulting surface forms a rectangle (or square). There are a plurality of apertures for securement illustrated as four securement or anchor apertures (e.g., first anchor aperture 642, second anchor aperture 644, third anchor aperture 646, and fourth anchor aperture 648—illustrated as circular apertures situated at the corners of the rectangular (or square) antenna). These securement or anchor apertures allow attachment of the antenna to a mounting surface via, for instance, threaded fasteners such as screws or nuts-and-bolts, or other suitable fasteners such as rivets. The antenna top layer 622 has a top surface 623. The upper patch antenna 656 resides on the top surface. A connection aperture 658 (as illustrated in FIG. 6C) of circular cross-section facilitates probe connection to the top patch of antenna. The connection aperture 658 is located midway between sides 604 and 608 and 32% of the way between sides first side 602 and third side 606, situated nearer to side first side 602. The width of the antenna top layer 622 is 50+/−0.2 mm, the height is also 50+/−0.2 mm, and the thickness is 3.2+/−0.2 mm. The distance between the anchor apertures (center-to-center) is 44+/−0.2 mm and the position of the connection aperture 658 is 25+/−0.2 mm from a first edge and 16+/−0.2 mm from a second edge, perpendicular to the first edge. For example, 25+/−0.2 mm from first side 602 and 16+/−0.2 mm from second side 604.

FIG. 6B is a side view of the antenna top layer 622. FIG. 6C is a bottom view of the antenna top layer 622. It also has a plurality of side (e.g., first side 602, second side 604, third side 606 and fourth side 608). The sides are situated at 90 degree angles so that the resulting surface forms a rectangle (or square). There are four securement apertures (e.g., first anchor aperture 642, second anchor aperture 644, third anchor aperture 646, and fourth anchor aperture 648—situated at the corners of the rectangle (square)). These securement or anchor apertures allow attachment of the antenna to a mounting surface via, for instance, threaded fasteners such as screws or nuts-and-bolts, or other suitable fasteners such as rivets. A connection aperture 658 of circular cross-section facilitates probe connection to the top patch of antenna. The connection aperture 658 is located midway between second side 604 and fourth side 608 and 32% of the way between first side 602 and third side 606, situated nearer to side 602.

Figure 6D:
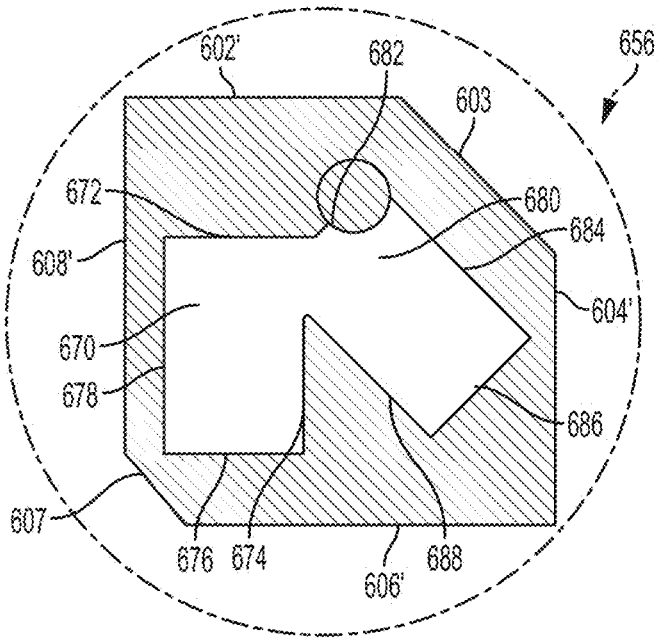
Figure 6E:
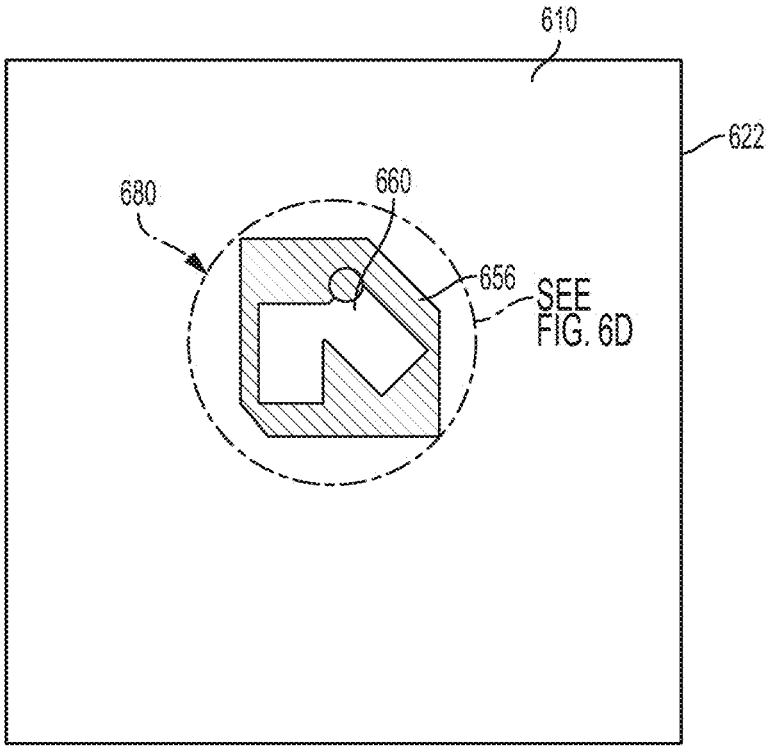

FIGS. 6D-E illustrate the upper patch antenna 656, which is mounted on the upper surface 610 of top layer of the antenna top layer 622. The antenna top layer 622 is of typical PCB construction and may be of PTFE composite formulation. It is planar and of uniform thickness. The upper patch antenna 656 has six sides 602', 603, 604', 606', 607, 608'. A rectangle is formed by sides 602', 604', 606'and 608' numbered clockwise) with truncated corners between sides 602' and 604' and sides 606' and 608' truncated at 45 degree angles to form additional truncated side 603 (between 602' and 604') and 607 (between 606' and 608'). The truncated sides 603 and 607 are positioned on opposing corners of the rectangular shape and are of different lengths, where the first truncated side 605 has a first length and the second truncated side 607 has a second length different than the first length. The resulting shape is that of a rectangle (square) with opposite corners truncated, each at a 45 degree angle. Within the bottom patch is a connection aperture (not shown) of circular cross-section that facilitates probe connection to the top patch of antenna. Within the upper patch is a "V-shaped" slot 660 or aperture consisting of two rectangles which overlap slightly, one of which has been rotated 45 degrees with respect to the other. The first rectangular aperture 670 has sides 672, 674, 676, 678, numbered clockwise when viewed from above. A first pair of sides are 1.5 times the length of a second pair of sides. Sides 672 and 676 are parallel to sides 602' and 606' of the upper patch antenna 656, while sides 674 and 678 are parallel to sides 604' and 608' of the upper patch antenna 656. A second rectangular aperture 680 connected to the first rectangular aperture 670 is defined by sides 682, 684, 686 and 688, numbered clockwise when viewed from above. A first two of the sides of the second rectangular aperture are the same length as a first two of the sides of the first rectangular aperture. A second two of the sides of the second rectangular aperture are, for example, 0.65 times the length of a second two of the sides of the first rectangular aperture. The second rectangular aperture 680 is positioned relative to the first rectangular aperture 670 so that the second rectangular aperture is rotated 45 degrees with respect to, for example, side 674 of the first rectangular aperture 670. The two rectangular apertures "overlap" such that the resulting aperture is "V-shaped" with one leg of the V perpendicular and the second leg of the V at a 45 degree angle. The length of side 684 is 7.5+/−0.2 mm; the length of side 686 is 4.9+/−0.2 mm; the distance between side 688 and side 674 is 45 degrees+/−0.2 degrees; the length of side 676 is 5+/−0.2 mm; and the length of side 678 is 7.5+/−0.2 mm.

Figure 7C:
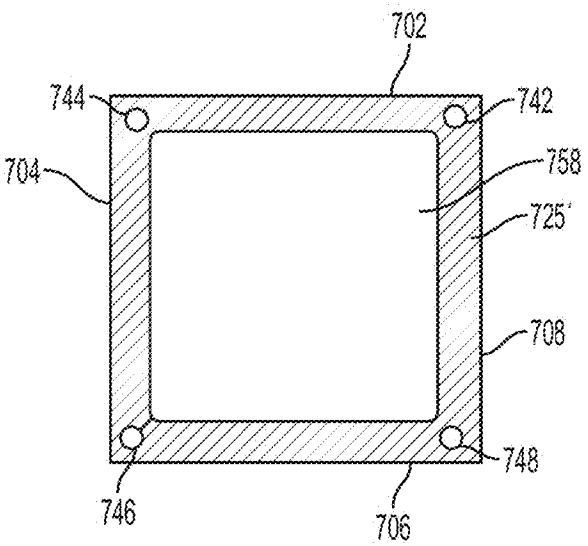
FIGS. 7A-C illustrates antenna components according to the disclosure.
Figure 7B:
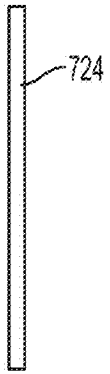
Figure 7A:
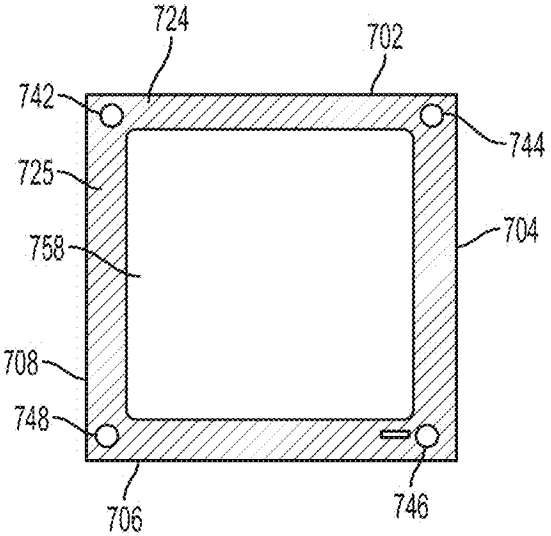

FIG. 7A is a top view of middle PCB layer 724. Middle PCB layer 724 is of typical PCB construction and may be of composite formulation. The middle PCB layer 724 is planar and of uniform thickness and has a middle PCB top surface 725. The middle layer PCB has first, second, third and fourth sides 702, 704, 706, 708, numbered clockwise when viewed from above. The sides 702, 704, 706, 708 are situated at 90 degree angles so that the resulting surface forms a rectangle (or square). A plurality of anchor apertures 742, 744, 746, 748 which are situated at the corners of the rectangle (square). The securement apertures allow attachment of the antenna to a mounting surface via, for instance, threaded fasteners such as screws or nuts-and-bolts, or other suitable fasteners such as rivets. The middle PCB layer 724 has a large, square central aperture 758. The sides of the central aperture are parallel to sides 702, 704, 706, and 708, such that the middle PCB layer 724 resembles a picture frame. The length and width is 50+/−0.2 mm. The thickness of the middle PCB layer 724 (FIG. 7B) is about 2+/−0.15 mm. The width of the square central aperture 758 is about 40+/−0.3 mm. The distance between the apertures (center-to-center) is 44+/−0.2 mm; and length and width of the central aperture 758 is 40+/−0.3 mm.

FIG. 7B is a side view of the middle PCB layer 724 and FIG. 7C is a bottom view of middle PCB layer 724 with middle PCB bottom surface 725'. It has first, second, third and fourth sides 702, 704, 706, 708. The sides are situated at 90 degree angles so that the resulting surface forms a rectangle (or square). As with other configurations, a plurality of securement apertures are provided, illustrated as four anchor apertures 742, 744, 746, 748 with circular cross-section—situated at the corners of the rectangle (square) to allow attachment of the antenna to a mounting surface via, for instance, threaded fasteners such as screws or nuts-and-bolts, or other suitable fasteners such as rivets. Evident in the figure is the large, square central aperture 758.

Figure 8C:
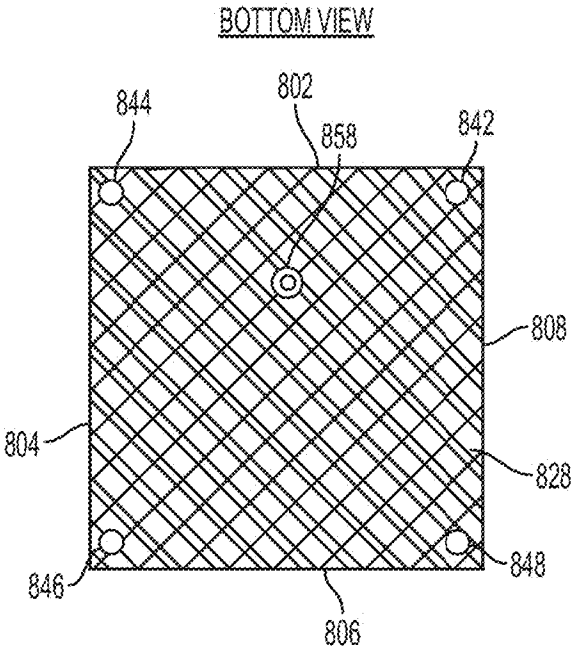
FIGS. 8A-E illustrates antenna components according to the disclosure.
Figure 8B:
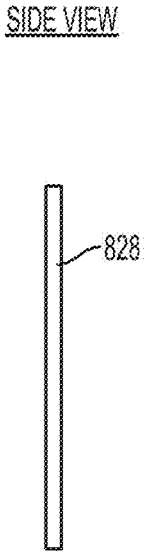
Figure 8A:
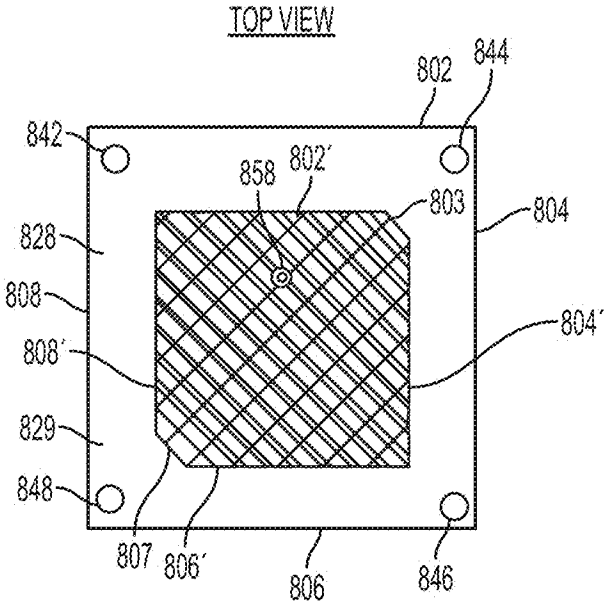

FIG. 8A is a top view of antenna bottom layer 828. As discussed above, the antenna bottom layer has a bottom substrate and a ground plane which forms a bottom layer of the bottom substrate. The antenna bottom layer 828 is of typical PCB construction and may be of PTFE composite formulation. It is planar, of uniform thickness, and has a top surface 829. It has first, second, third and fourth sides 802, 804, 806, 808, numbered clockwise when viewed from above. The sides are situated at 90 degree angles so that the resulting surface forms a rectangle (or square). Four apertures are illustrated with circular cross-section 842, 844, 846, 848—situated at the corners of the rectangle (square). These apertures allow attachment of the antenna to a mounting surface via, for instance, threaded fasteners such as screws or nuts-and-bolts, or other suitable fasteners such as rivets shown in, for example, FIG. 4. An aperture 858 of circular cross-section facilitates probe connection to the top patch of antenna. The aperture 858 is located midway between second side 804 and fourth side 808 and 32% of the way between first side 802 and third side 806, situated nearer to the first side 802. The lower patch antenna 814 a first side 802', a second side 804', a third side 806', and a fourth side 808'. Two opposing truncated ends 803 and 807 are provided. The thickness of the antenna bottom layer 828 (FIG. 8B) is about 1.57+/−0.12 mm. The aperture 858 is positioned about 25+/−0.3 mm from the first fourth side 804 and about 16+/−0.3 mm from the first side 802.

FIG. 8B is a side view of antenna bottom layer 828. FIG. 8C is a bottom view of the bottom layer. It has first, second, third and fourth sides 802, 804, 806, 808, numbered counterclockwise when viewed from above. The sides are situated at 90 degree angles so that the resulting surface forms a rectangle (or square). Illustrated are four connection apertures having a circular cross-section 842, 844, 846, 848 situated at the corners of the rectangle (square) to allow attachment of the antenna to a mounting surface via, for instance, threaded fasteners such as screws or nuts-and-bolts, or other suitable fasteners such as rivets. On the bottom layer PCB is aperture 858 of circular cross-section facilitates probe connection to the top patch of antenna. The aperture is located midway between second side 804 and fourth side 808 and 32% of the way between first side 802 and third side 806, situated nearer to the first side 802. Copper plating can be provided on the bottom surface.

Figure 8E:
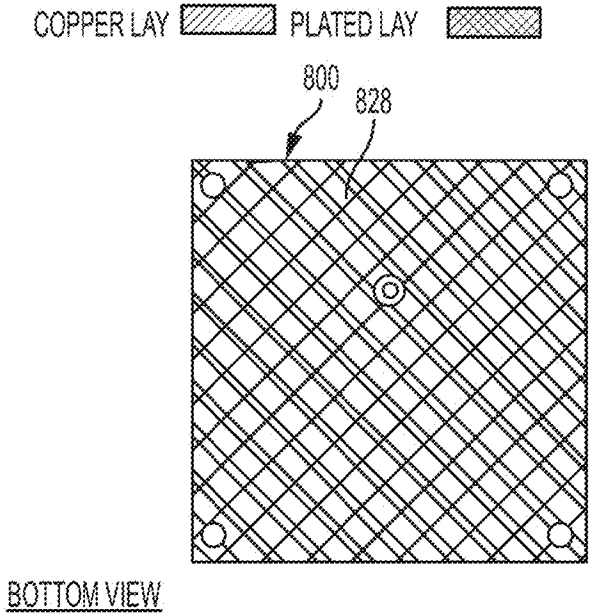
Figure 8D:
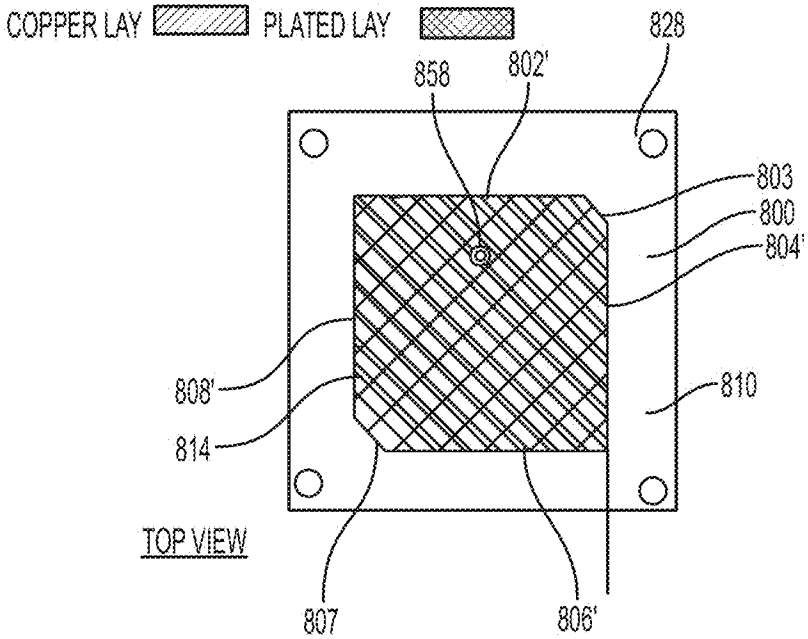

FIG. 8D-E are a detailed views of lower patch antenna 814, which is mounted on the top surface 810 of bottom layer PCB 800. The bottom layer is of typical PCB construction and may be of PTFE composite formulation. It is planar and of uniform thickness. The lower patch antenna 814, which is mounted on the top surface of the bottom layer PCB, has six sides. The shape is that of a rectangle (formed by sides 802', 804', 806' and 808' numbered clockwise) with corners 803, 807 between a first pair of sides 802' and 804' and a second pair of sides 806' and 808' truncated at 45 degree angles to form additional linking sides. The truncated linking sides 803 and 807 are the same length and are positioned at opposite corners of the rectangle. The resulting shape is that of a rectangle (square) with opposite corners truncated, each at a 45 degree angle. Within the bottom patch is an aperture 858 of circular cross-section that facilitates probe connection to the top patch of antenna. The antenna bottom layer 828 of the bottom layer PCB 800 (shown in FIG. 8E) is plated with, for example, copper, to facilitate grounding of the antenna assembly when mounted to the grounding plane shown in FIGS. 4 and 5. The total length of the sides of the lower patch antenna 814 is 31.8+/−2 mm in length and width (extending the length of the side as though the truncated portion were part of the shape), the truncated portion (e.g., 803) begins at 4.3+/−0.2 mm before the edge of the adjacent side (e.g., 804').

In operation the patch is excited by a standard single-pin unbalanced feed. The top patch is probe-fed and the bottom patch is fed via coupling. The bottom patch is fed by coupling between the bottom patch and the feed probe. The two rectangular patches are excited to TM11 resonant modes with each patch resonating at a desired frequency band. The antenna is configurable so that the top patch resonates at an upper resonance, while the lower patch resonates at a lower resonance. A circular polarization is created by truncating corners and feeding the antenna to excited the TM11 mode. The bottom patch axial ratio is thus limited by the TM11 excitation method. Additionally the upper patch's axial ratio is increased by the use of a v-shaped slot in the upper patch. The patch structure provides the medium gain and directive pattern while the materials choice(s) and substrate thickness(es) deliver the high efficiency.

Figure 9:
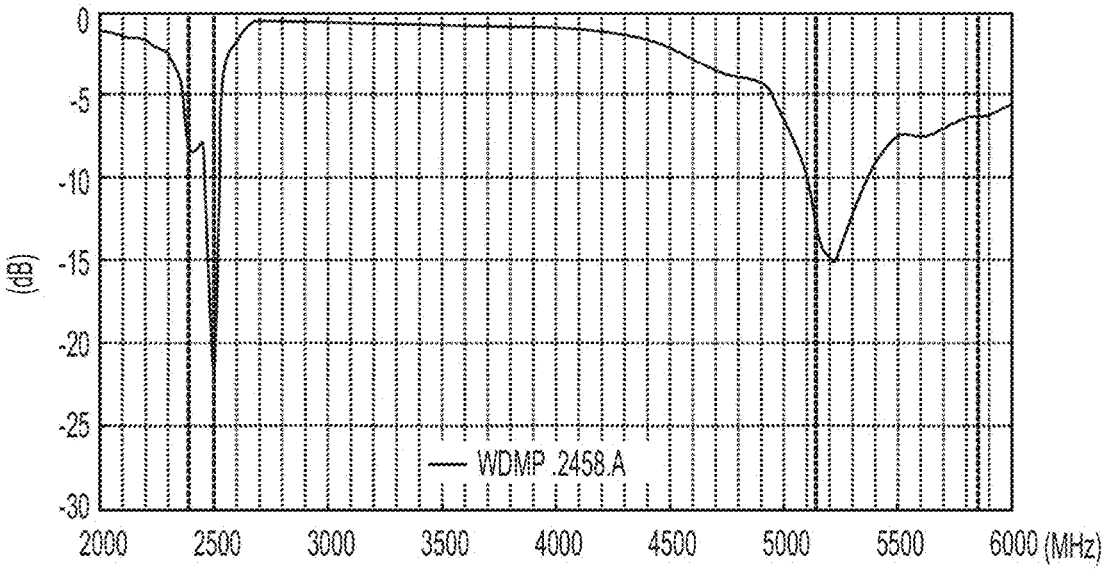
FIG. 9 illustrates a return loss over a range of 2000-6000 MHz of an antenna according to the disclosure.
Figure 10:
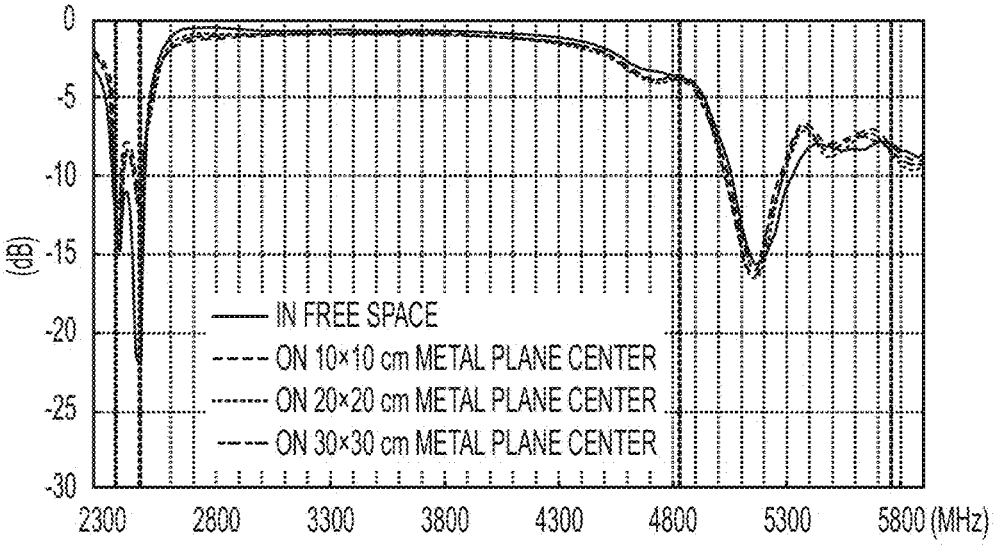
FIG. 10 illustrates a return loss in free space and centered on three different size metal planes over a range of 2300-6000 MHz for an antenna according to the disclosure.
Figure 11:
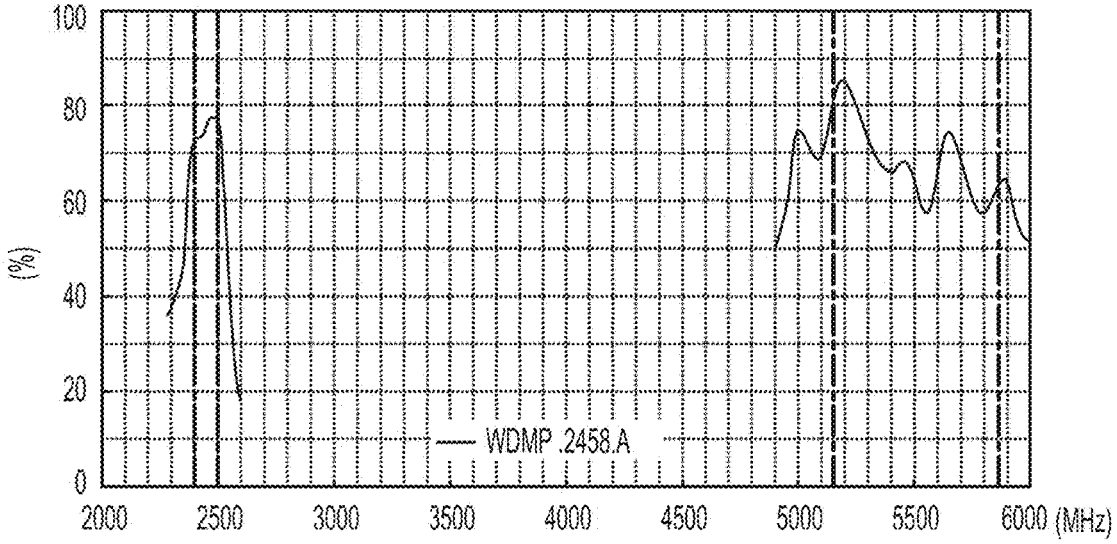
FIG. 11 illustrates a percent efficiency over a range of 2000-6000 MHz for an antenna according to the disclosure.
Figure 12:
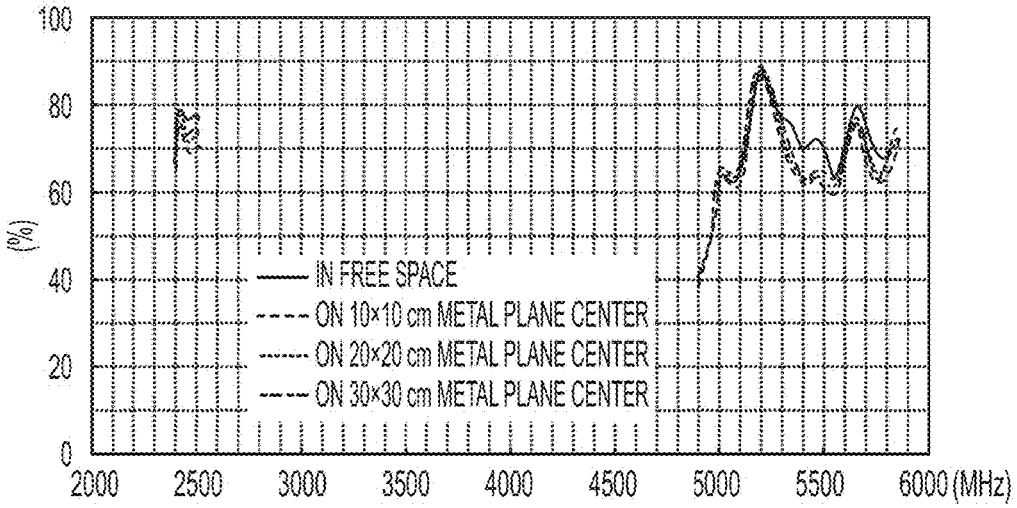
FIG. 12 illustrates a percent efficiency in free space and centered on three different size metal ground planes over a range of 2000-6000 MHz for an antenna according to the disclosure.
Figure 13:
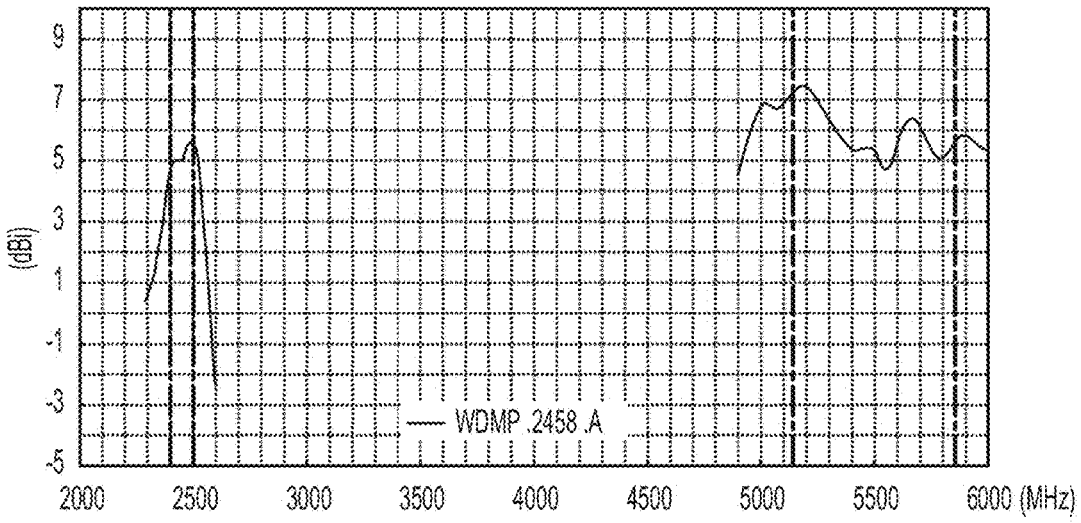
FIG. 13 illustrates a peak gain over a range of 2000-6000 MHz for an antenna according to the disclosure.

FIG. 9 illustrates a return loss over a range of 2000-6000 MHz of an antenna according to the disclosure;

FIG. 10 illustrates a return loss in free space and centered on three different size metal planes over a range of 2300-6000 MHz for an antenna according to the disclosure;

The antenna may be implemented using various printed circuit board materials, including Rogers 5870 and commodity FR4.Depending on the substrate material(s) employed, dimensions may need to be adjusted accordingly. Generally, lower-loss materials will deliver higher efficiency and gain. Specifically, substrates with a low dielectric constant and low dissipation factor, can be used such as glass microfiber reinforced polytetrafluoroethylene (PTFE), Teflon®. Such substrates minimize signal transmission loss in order to achieve high efficiency. Antennas employing such materials perform with high efficiencies at WiFi bands from 2400~2500 MHz and 5150~5850 MHz of 74% and 67%, and with peak gains of 5.5 dBi and 7.3 dBi respectively, as displayed in FIGS. 11-13 where FIG. 11 illustrates a percent efficiency over a range of 2000-6000 MHz, FIG. 12 illustrates a percent efficiency in free space and centered on three different size metal ground planes over a range of 2000-6000 MHz, and FIG. 13 illustrates a peak gain over a range of 2000-6000 MHz.

Figure 14:
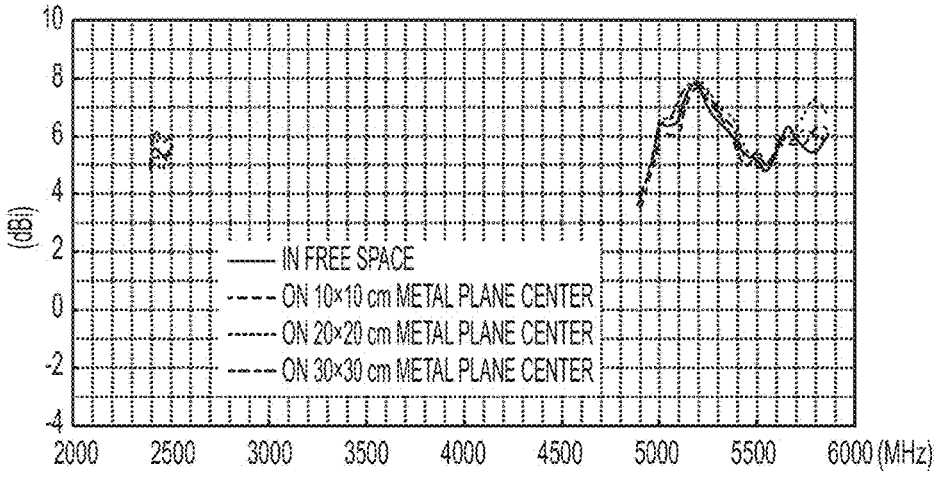
FIG. 14 illustrates a peak gain in free space and centered on three different size metal ground planes over a range of 2000-6000 MHz for an antenna according to the disclosure.
Figure 15:
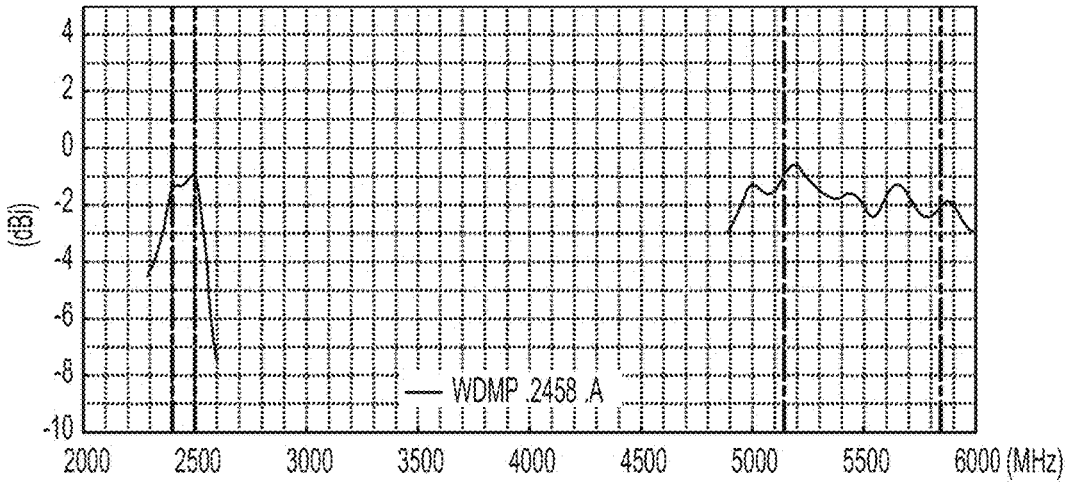
FIG. 15 illustrates an average gain over a range of 2000-6000 MHz for an antenna according to the disclosure.

FIG. 14 illustrates a peak gain in free space and centered on three different size metal ground planes over a range of 2000-6000 MHz for an antenna according to the disclosure;

FIG. 15 illustrates an average gain over a range of 2000-6000 MHz.

Figure 16A:
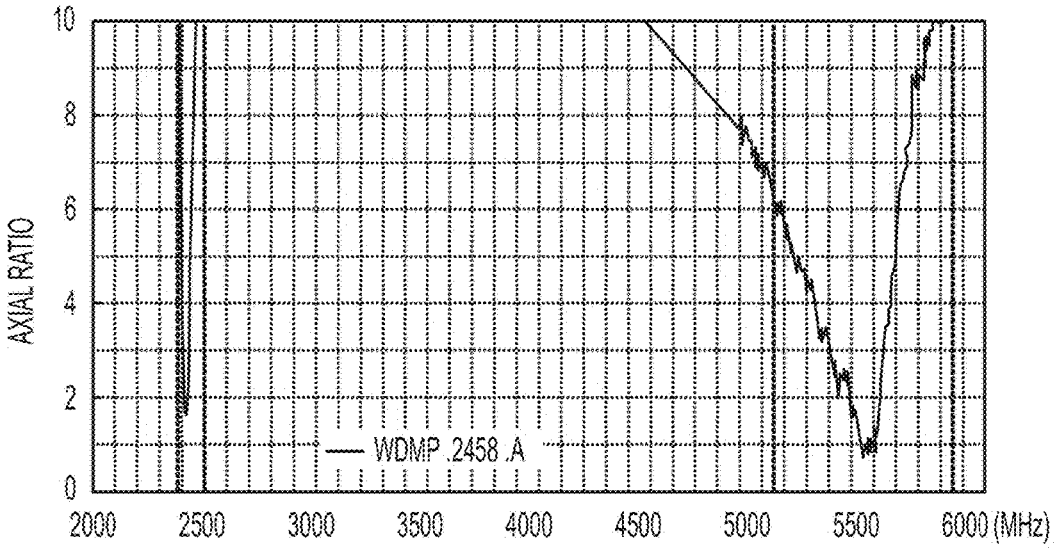
FIGS. 16A-C illustrate an axial ratio over a range of 2000-6000 MHz for an antenna according to the disclosure.
Figure 16B:
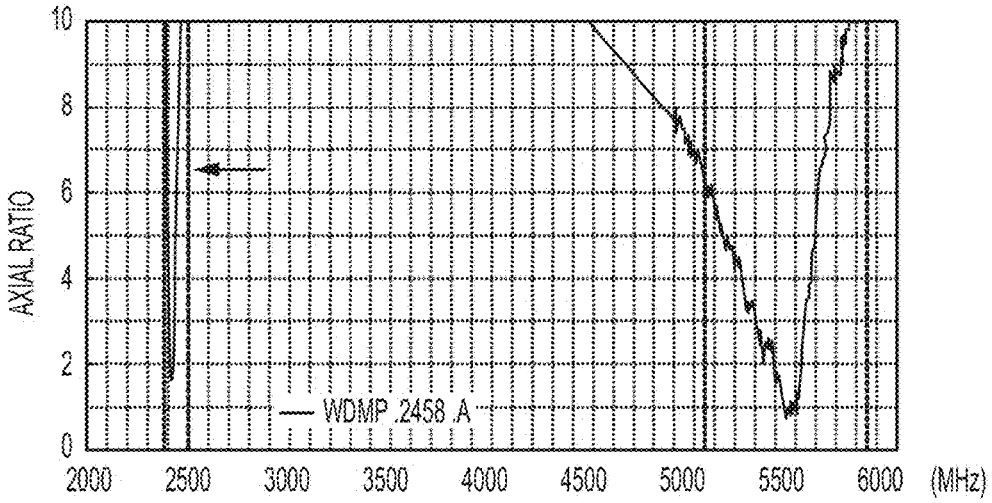
Figure 16C:
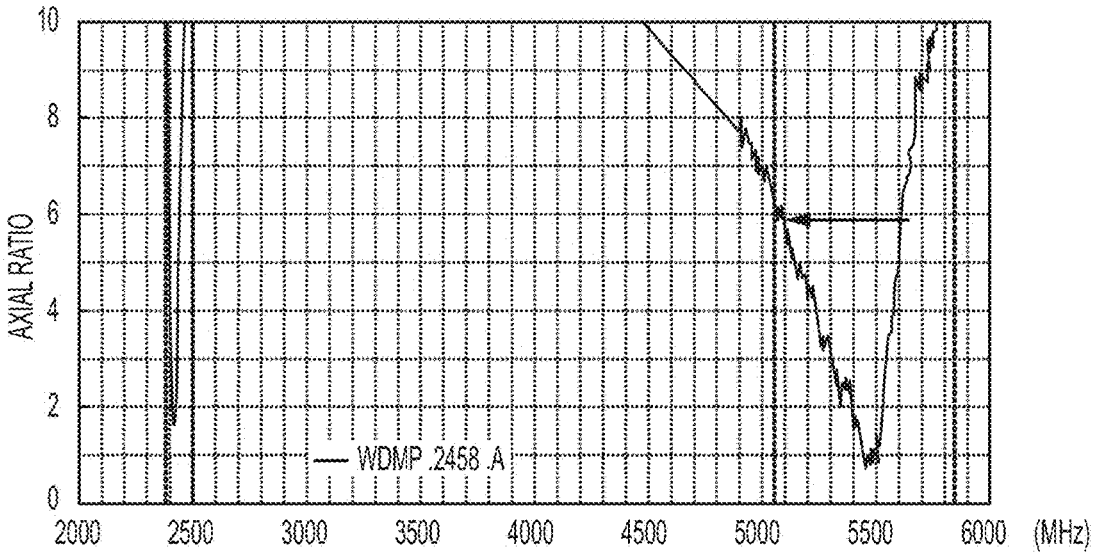

The upper patch is rectangular in shape with opposite corners truncated at 45 degrees to produce circular polarization. Within the patch is a novel, v-shaped slot configuration, consisting of two rectangular slots, one of which is aligned with a major side of the patch, and a replica that is rotated 45 degrees about the inside corner and shifted left by 1 mm so that it is aligned with one truncated side of the patch. The length and width of each slot is proportional, respectively, to one eighth the wavelength of the upper and lower limits of the higher frequency band. The use of overlapping slots is suitable for wideband antenna matching and delivers the wideband axial ratio of the upper band as shown in FIGS. 16A-C which illustrates an axial ratio over a range of 2000-6000 MHz.

The lower patch is rectangular in shape with opposite corners truncated at 45 degrees to produce circular polarization. Compared to the upper patch, the lower patch has a narrower axial ratio as displayed in FIGS. 16A-C.

Figure 17B:
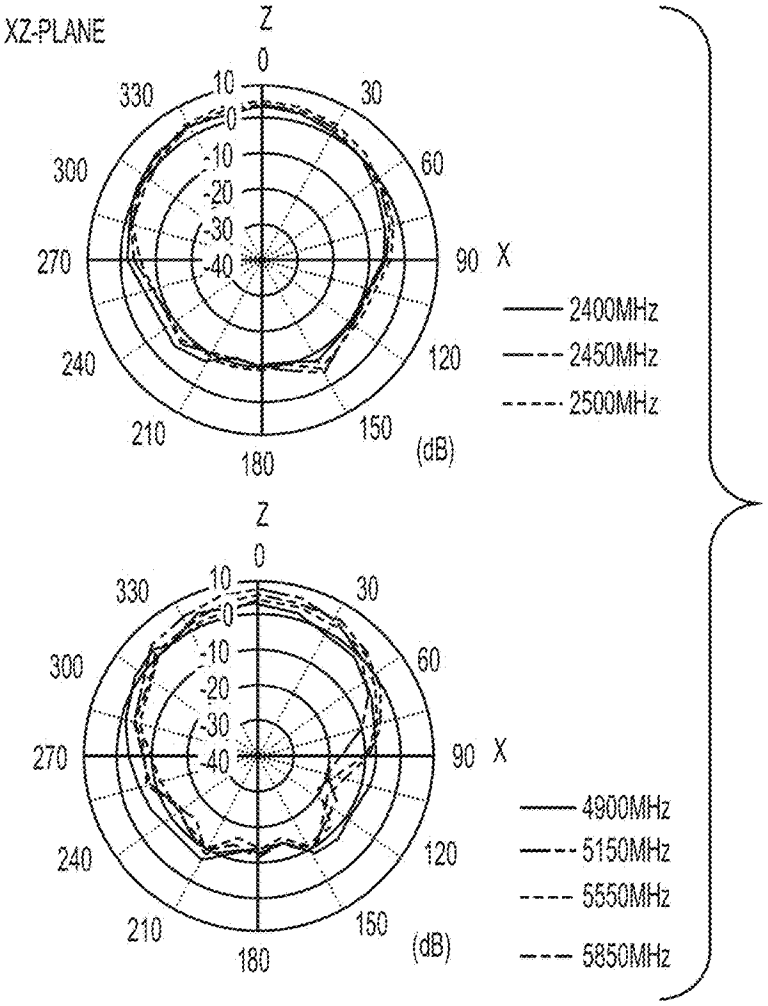
FIGS. 17A-C illustrate two-dimensional (2D) radiation patterns in an X-Y plane, an X-Z plane, and a Y-Z plane for the disclosed antennas.
Figure 17A:
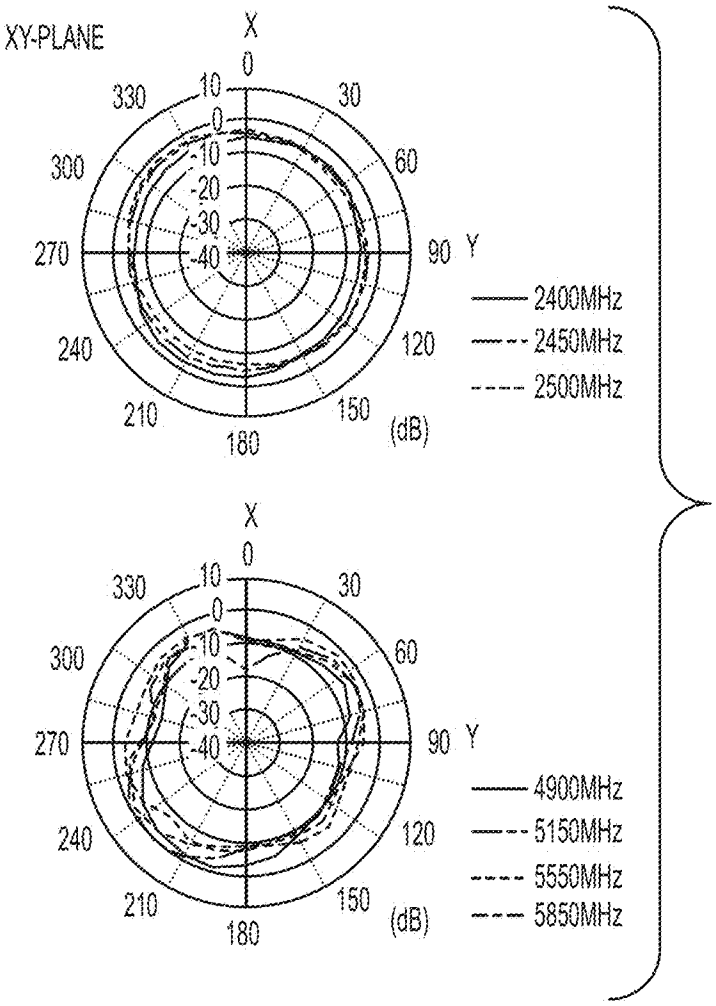
Figure 18A:
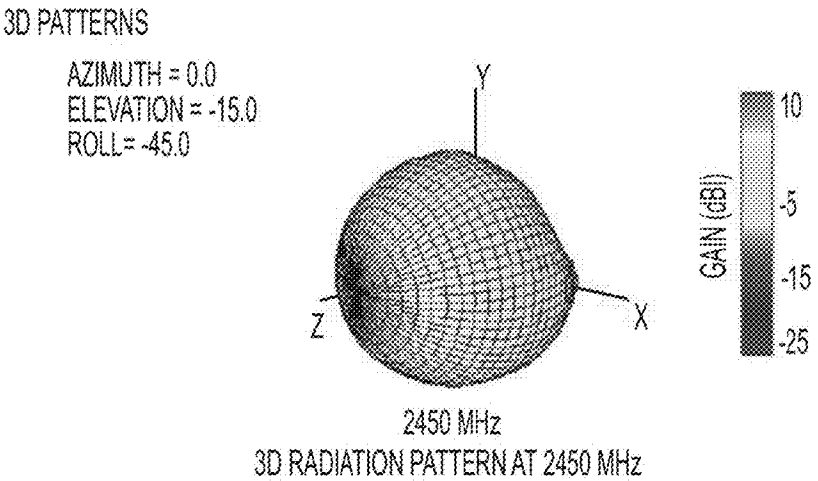
FIGS. 18A-B illustrate a three-dimensional (3D) radiation pattern at 2450 MHz and 5550 MHz for the disclosed antennas.
Figure 18B:
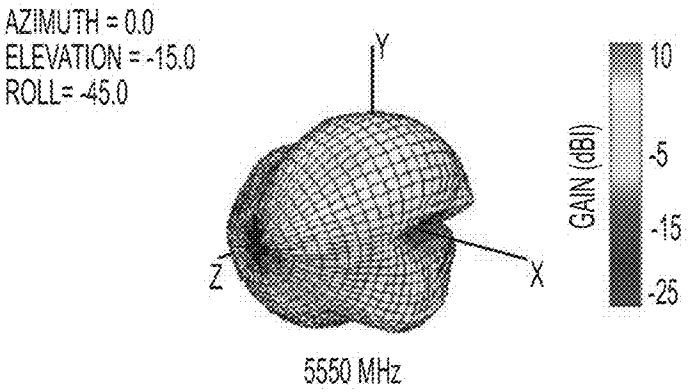
Figure 17C:
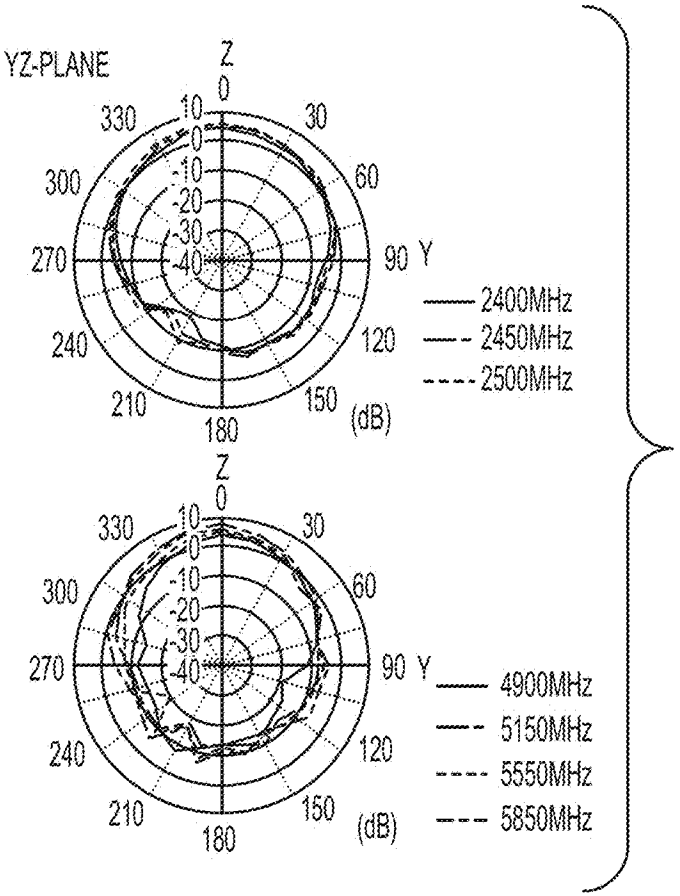

FIGS. 17A-C illustrate two-dimensional (2D) radiation patterns in an X-Y plane, an X-Z plane, and a Y-Z plane, and FIGS. 18A-B illustrate a three-dimensional (3D) radiation pattern at 2450 MHz and 5550 MHz.

The antenna described herein offers a number of advantages (in both structure and performance) over existing designs. To wit, the lower and upper frequency bands are arbitrarily related and independently set by the dimensions of the lower and upper patches, respectively. This enables greater flexibility in applications for the antenna than alternatives currently available. In contrast to many current designs, the axial ratio bandwidth of the upper frequency band is large, while retaining a simple feed mechanism. Unlike complex structures offered by many current designs, the structure of the antenna described herein is simply constructed using three printed circuit boards, which are manufactured using standard PCB production techniques. This results in reduced production cost compared to alternatives. The simplicity of the structure itself enables easy integration into a system using the four mounting apertures provided, thus achieving additional cost savings.

Using a circular polarized signal enables the link to have increased stability for devices where the direction of orientation is unknown or where multipath is an issue.

A low profile design equipped with an SMA(F) connector, is easy to install inside a housing or directly onto a printed circuit board (PCB) mainboard. The board has a plurality of thru-holes or apertures at the patch corners, allowing users to secure the antenna with screws, as shown in FIGS. 3 and 4-5. The antenna has passed ISO 16750 high/low-temperature test and random vibration reliability testing.

Many module manufacturers specify peak gain limits for any antennas that are to be connected to that module. Those peak gain limits are based on free-space conditions. In practice, the peak gain of an antenna tested in free-space can degrade by at least 1 or 2 dBi when put inside a device. A slightly higher peak gain antenna can be provided to compensate for this effect, providing better performance.

Antennas are typically incorporated into other devices. Upon testing of the disclosed antennas the antennas' peak gain can be adjusted to fall below a target peak gain limit required by the device into which the antenna is incorporated.

For example, a module manufacturer may state that the antenna must have less than 2 dBi peak gain, due to the configurability of the disclosed antennas, the module manufacturer would not need to select an embedded antenna that has a peak gain of less than 2 dBi in free-space. A slightly higher free-space peak gain of 3 dBi may be suitable under these target configuration. Once the antenna disclosed herein is integrated into a device requiring less than 2 sBi peak gain, performance will degrade below the target 2 dBi peak gain limit due to the effects of GND plane, surrounding components, and device housing.

The antennas disclosed herein can be made available as part of a kit. The kit comprises, for example, a planar antenna comprising a substrate having a substantially square shape, a conductive layer attached to a first surface of the substrate wherein the conductive layer further comprises an antenna section which includes a monopole planar inverted-F antenna adapted and configured to efficiently operate in a dual band mode and a radiation control section, and a ground section connected to the inverted-F antenna by a connector region, and a flexible cable adaptable to connect the planar antenna to a target device. Additionally, the kit may include, for example, suitable mounting material, such as 3M adhesive transfer tape. Other components can be provided in the kit as well to facilitate installation of the antenna in a target device. The kit can be packaged in suitable packaging to allow transport. Additionally, the kit can include multiple antennas, such that antennas and cables are provided as 10 packs, 50 packs, 100 packs, and the like.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed:

1. A planar dual patch antenna comprising:

a first planar substrate having a first patch antenna and a v-shaped slot therein;

a second planar substrate formed from a composite material with dielectric properties and a square aperture centrally positioned therein;

a third planar substrate having a ground layer adhered to one surface and a second patch antenna on an opposing surface;

a single-pin feed; and a coupling between the first patch antenna on the first planar substrate and the second patch antenna on the third planar substrate.

2. The planar dual patch antenna of claim 1 wherein the first planar substrate is rectangular.

3. The planar dual patch antenna of claim 2 wherein the first planar substrate has two truncated corners.

4. The planar dual patch antenna of claim 3 wherein a first truncated corner has a first length and a second truncated corner has a second length and further wherein the first length is not equal to the second length.

5. The planar dual patch antenna of claim 1 wherein the v-shaped slot has a first slot arm and a second slot arm, and further wherein a length of the first slot arm and a width of a second slot arm is proportional to a length of the second slot arm and a width of the second slot arm.

6. The planar dual patch antenna of claim 5 wherein the first slot arm is ⅛ a dimension of the second slot arm.

7. The planar dual patch antenna of claim 1 wherein the planar dual patch antenna is square or rectangular.

8. The planar dual patch antenna of claim 1 wherein the second substrate has a connector aperture.

9. A planar dual patch antenna comprising:

a first planar substrate means having a first patch antenna means and a v-shaped slot therein;

a second planar substrate means formed from a composite material with dielectric properties and a square aperture centrally positioned therein;

a third planar substrate means having a ground layer means adhered to one surface and a second patch antenna on an opposing surface;

a single-pin feed; and a coupling means between the first patch antenna means on the first planar substrate means and the second patch antenna on the third planar substrate means.

10. The planar dual patch antenna of claim 9 wherein the first planar substrate means is rectangular.

11. The planar dual patch antenna of claim 10 wherein the first planar substrate means has two truncated corners.

12. The planar dual patch antenna of claim 11 wherein a first truncated corner has a first length and a second truncated corner has a second length and further wherein the first length is not equal to the second length.

13. The planar dual patch antenna of claim 9 wherein the v-shaped slot has a first slot arm and a second slot arm, and further wherein a length of the first slot arm and a width of a second slot arm is proportional to a length of the second slot arm and a width of the second slot arm.

14. The planar dual patch antenna of claim 13 wherein the first slot arm is ⅛ a dimension of the second slot arm.

15. The planar dual patch antenna of claim 9 wherein the planar dual patch antenna is square or rectangular.

16. An antenna kit comprising:

a dual patch antenna comprising a first planar substrate having a first patch antenna and a v-shaped slot therein, a second planar substrate formed from a composite material with dielectric properties and a square aperture centrally positioned therein, a third planar substrate having a ground layer adhered to one surface and a second patch antenna on an opposing surface, a single-pin feed, and a coupling between the first patch antenna on the first planar substrate and the second patch antenna on the third planar substrate.

17. A planar dual patch antenna comprising:

a first planar substrate means having a first patch antenna and a v-shaped slot therein;

a second planar substrate means formed from a composite material with dielectric properties and a square aperture centrally positioned therein;

a third planar substrate means having a ground layer adhered to one surface and a second patch antenna on an opposing surface;

a single-pin feed means; and a coupling between the first patch antenna on the first planar substrate and the second patch antenna on the third planar substrate.

18. The planar dual patch antenna of claim 17 wherein the first planar substrate means is rectangular.

19. The planar dual patch antenna of claim 17 wherein the first planar substrate means has two truncated corners.

20. The planar dual patch antenna of claim 19 wherein a first truncated corner has a first length and a second truncated corner has a second length and further wherein the first length is not equal to the second length.

21. The planar dual patch antenna of claim 17 wherein the v-shaped slot has a first slot arm and a second slot arm, and further wherein a length of the first slot arm and a width of a second slot arm is proportional to a length of the second slot arm and a width of the second slot arm.

22. The planar dual patch antenna of claim 21 wherein the first slot arm is ⅛ a dimension of the second slot arm.

23. The planar dual patch antenna of claim 17 wherein the planar dual patch antenna is square or rectangular.

24. The planar dual patch antenna of claim 17 wherein the second substrate has a connector aperture.

* * * * *